US006022259A

United States Patent [19]

Rudawsky et al.

[11] Patent Number: 6,022,259

[45] **Date of Patent: *Feb. 8, 2000**

[54] APPARATUS FOR STORING FASHION DOLL CLOTHES AND ACCESSORIES

[76] Inventors: Basil L. Rudawsky; Deborah L. Rudawsky, both of 1211 Ticonderoga Dr., Chesterfield, Mo. 63017

[ * ] Notice: This patent issued on a continued prosecution application filed under 37 CFR 1.53(d), and is subject to the twenty year patent term provisions of 35 U.S.C. 154(a)(2).

[21] Appl. No.: 08/636,924

[22] Filed: Apr. 24, 1996

[51] Int. Cl.[7] ..... A63H 33/16; A63H 33/00; A63H 3/08

[52] U.S. Cl. ..... 446/80; 446/488; 446/98; 446/901

[58] Field of Search ..... 446/80, 75, 74, 446/73, 72, 71, 98, 97, 268, 488, 487, 901; 312/258

[56] References Cited

U.S. PATENT DOCUMENTS

| | | | |
|---|---|---|---|
| 243,873 | 7/1881 | Dorn et al. | 446/75 |
| 1,889,760 | 12/1932 | Peters | 312/258 X |
| 3,274,706 | 9/1966 | Friend | 446/75 X |
| 3,316,699 | 5/1967 | Nachbar | 446/98 X |
| 4,403,000 | 9/1983 | Gates | 446/98 X |
| 4,543,278 | 9/1985 | Ackerman | 446/901 X |
| 4,696,652 | 9/1987 | Reeder et al. | 446/75 |
| 4,911,670 | 3/1990 | McNicholas et al. | 446/74 |
| 5,118,318 | 6/1992 | Lorizio | 446/901 X |
| 5,178,573 | 1/1993 | Smith | 446/73 |
| 5,250,000 | 10/1993 | Boutin et al. | 446/75 |
| 5,332,093 | 7/1994 | Littlepage | 446/73 X |
| 5,403,223 | 4/1995 | Gaulkin et al. | 446/73 X |
| 5,540,609 | 7/1996 | Hoag | 446/901 X |

FOREIGN PATENT DOCUMENTS

| | | | |
|---|---|---|---|
| 2010102 | 6/1979 | United Kingdom | 446/75 |

*Primary Examiner*—D Neal Muir
*Attorney, Agent, or Firm*—Armstrong Teasdale LLP

[57] ABSTRACT

A fashion doll clothes holder for doll clothes and accessories of the type having fasteners having a plurality of panels hingedly connected together to form an enclosure. The enclosure has an inner surface including fasteners adapted to releasably engage the fasteners on doll clothes and accessories to secure the doll clothes and accessories to the panels.

12 Claims, 3 Drawing Sheets

APPARATUS FOR STORING FASHION DOLL CLOTHES AND ACCESSORIES

FIELD OF THE INVENTION

This invention relates to a method of, and an apparatus for, storing fashion doll clothes and accessories.

BACKGROUND AND SUMMARY

A wide selection of clothes and accessories are available for fashion dolls. Storing a large collection of these clothes and accessories in an organized manner can be difficult, particularly for younger users. Some of the presently available storage cases simply hold these clothes and accessories in a large mass, which can make it difficult to find a particular item. Some of the other presently available storage cases use doll-sized hangers to store coordinating outfits. Using these hangers is a difficult and tedious task, and the hangers often go unused.

The present invention provides a method and apparatus for storing fashion clothes and accessories that is simple and easy to use, yet maintains the clothes and accessories in an organized manner. Generally, the fashion doll clothes holder of this invention comprises a plurality of panels hingedly connected together to form an enclosure. The panels have inner surfaces which include a plurality of fasteners adapted to releasably engage fasteners on doll clothes and accessories to secure these clothes and accessories to the interior of the enclosure.

The method of this invention comprises providing a plurality of panels hingedly connected together to form an enclosure, the enclosure having a surface that is covered with fasteners that can releasably engage fasteners on doll clothes and accessories. The method comprises releasably securing the doll clothes and accessories on the surface by attaching the fasteners on the doll clothes and accessories to the fasteners on the surface. The container is then closed with the doll clothes and accessories secured on the surface.

The apparatus is thus of simple and inexpensive construction. The method and apparatus are easy to use, even for young children; and allow the doll clothes to be stored in an organized manner. These and other features and advantages will be in part apparent, and in part pointed out, hereinafter.

BRIEF DESCRIPTION OF THE DRAWINGS

Corresponding reference numerals indicate corresponding parts throughout the drawings.

DETAILED DESCRIPTION OF THE PREFERRED EMBODIMENT

Figure 1:
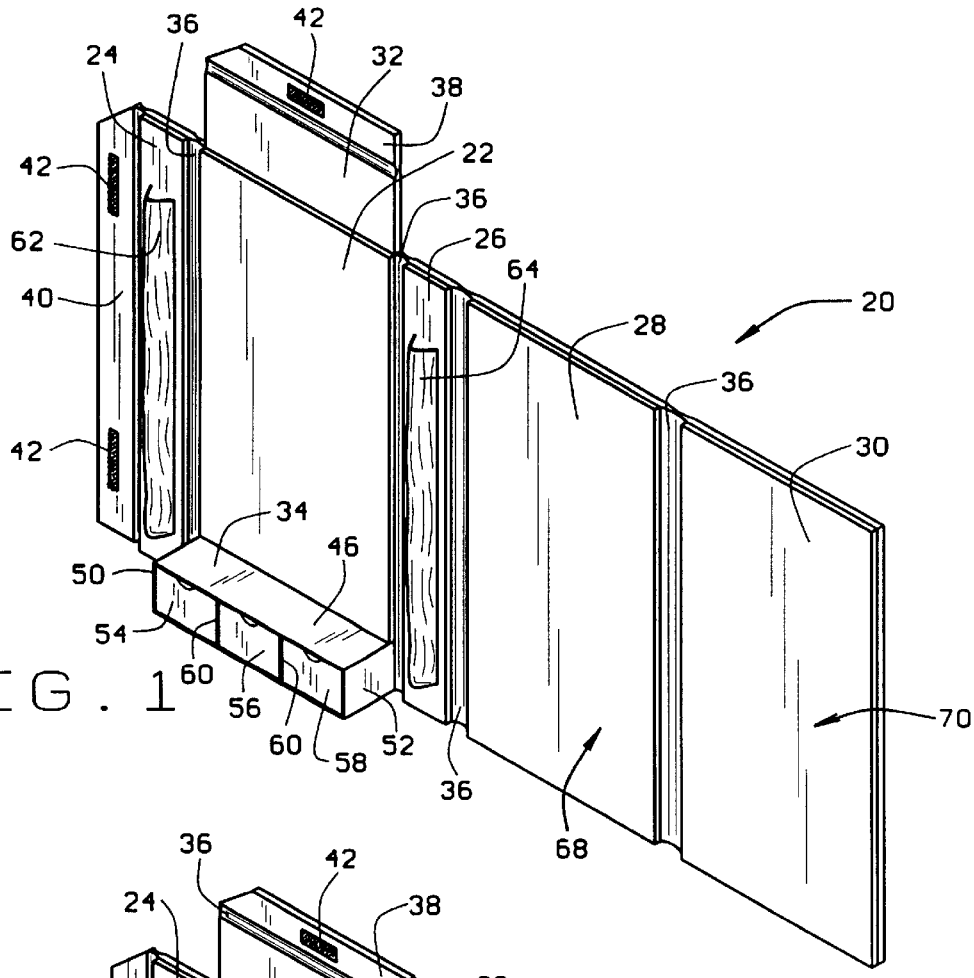
FIG. 1 is a perspective view of a fashion doll clothes holder constructed according to the principles of this invention.
Figure 2:
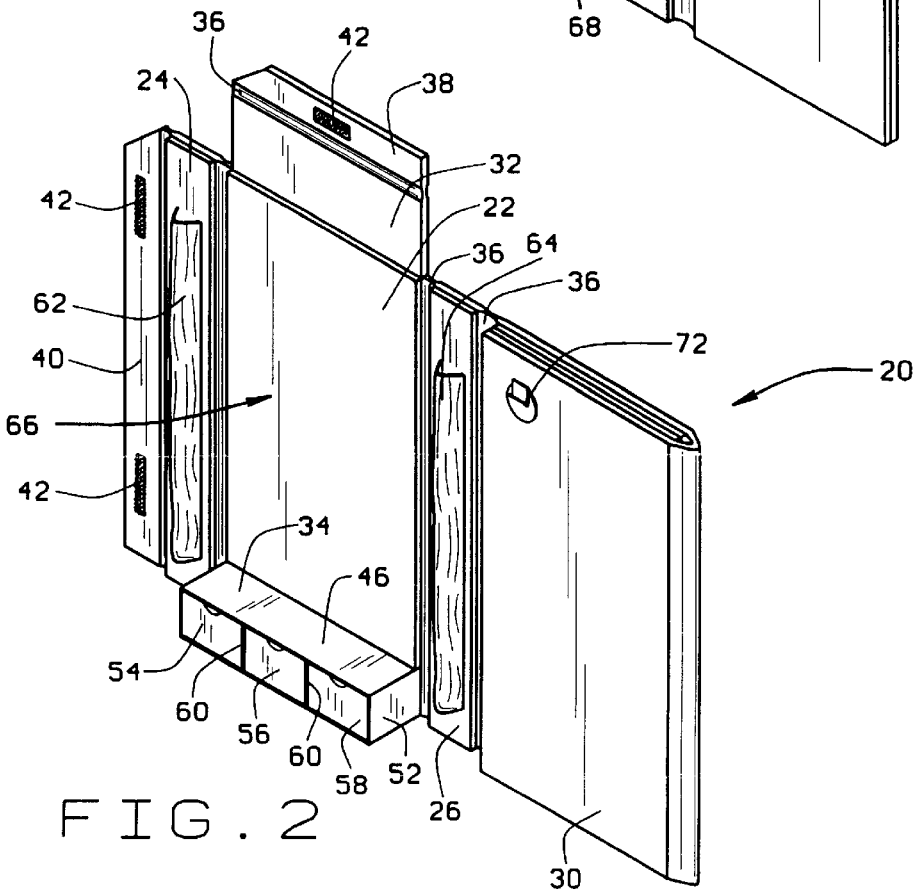
FIG. 2 is perspective view of the fashion doll clothes holder shown with two of the interconnected panels folded together.
Figure 3:
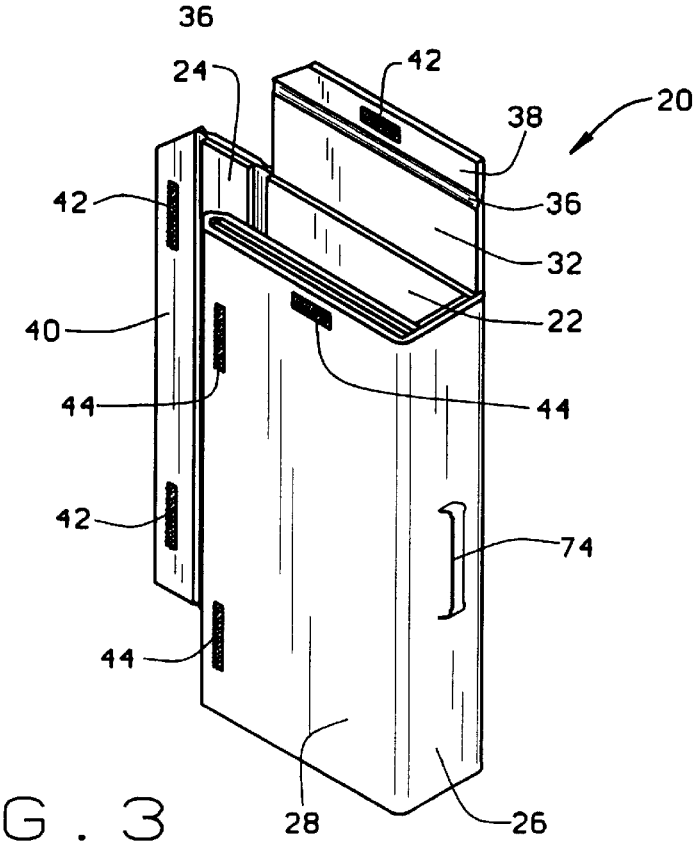
FIG. 3 is a perspective view of the fashion doll clothes holder shown with the interconnected panels folded into a generally rectangular box configuration.
Figure 4:
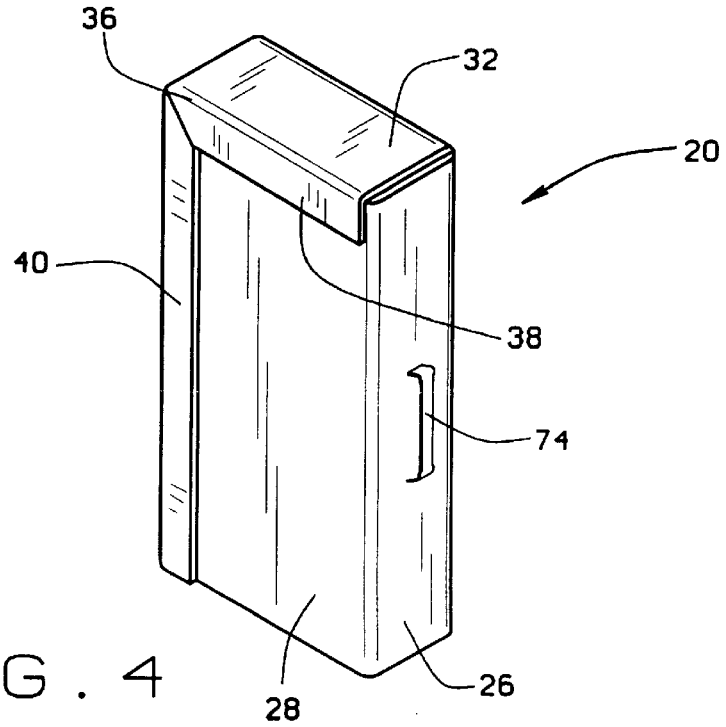
FIG. 4 is a perspective view of the fashion doll clothes holder shown folded into a generally rectangular box configuration, with the top and side panels folded over across the interconnected panels and the top and side flaps securing the interconnected panels together.
Figure 5:
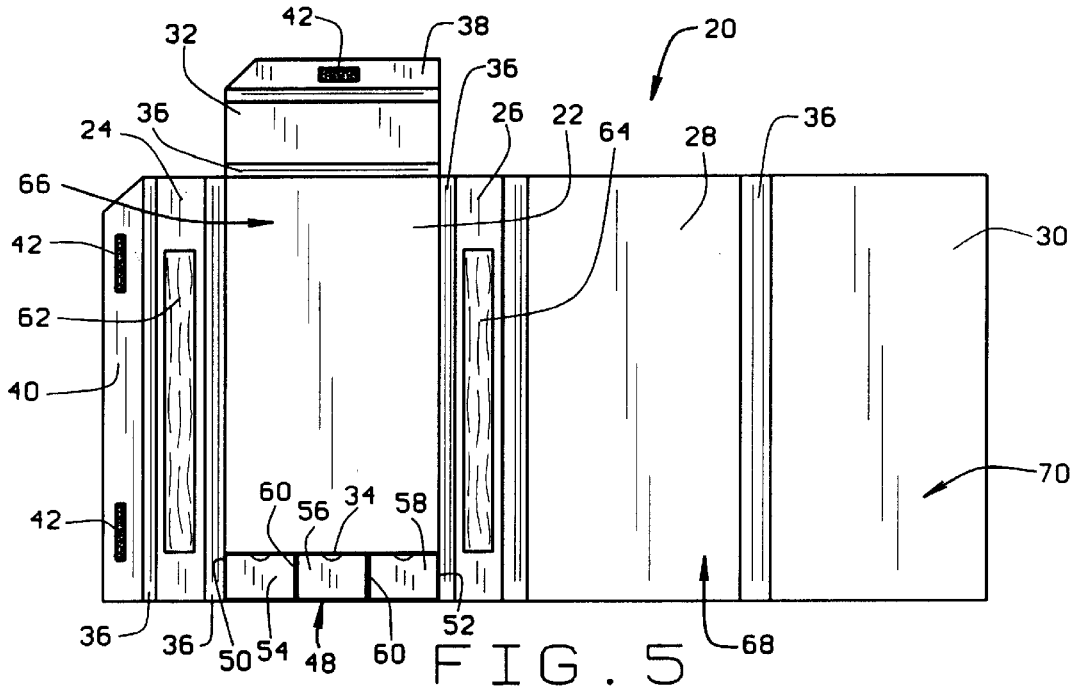
FIG. 5 is a front elevation view of the fashion doll clothes holder.
Figure 6:
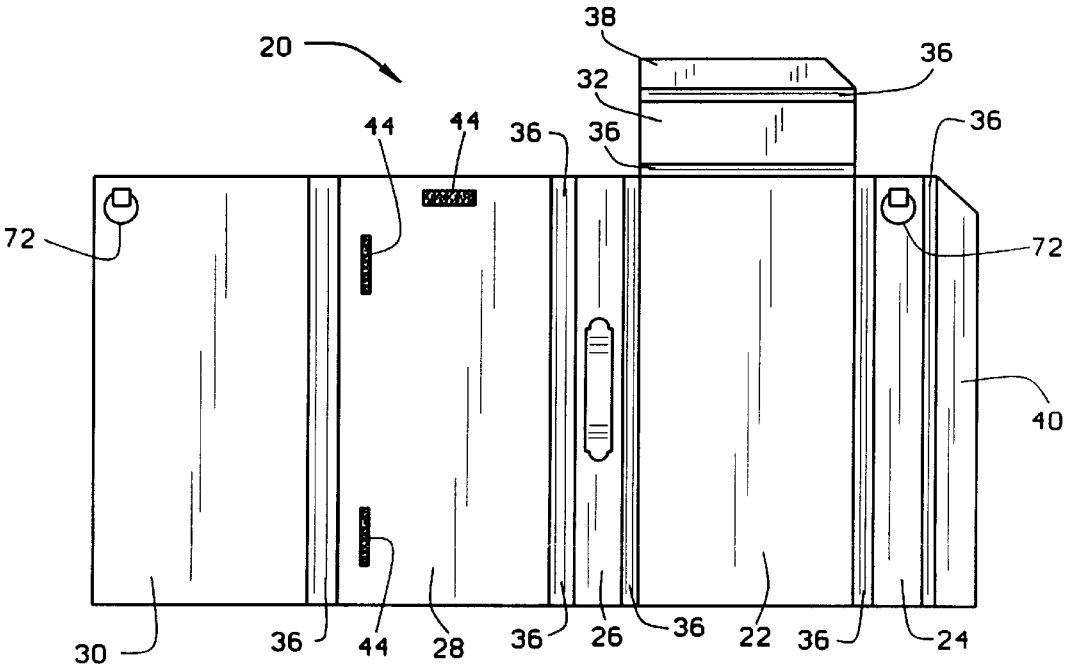
FIG. 6 is a rear elevation view of the fashion doll clothes holder.
Figure 7:
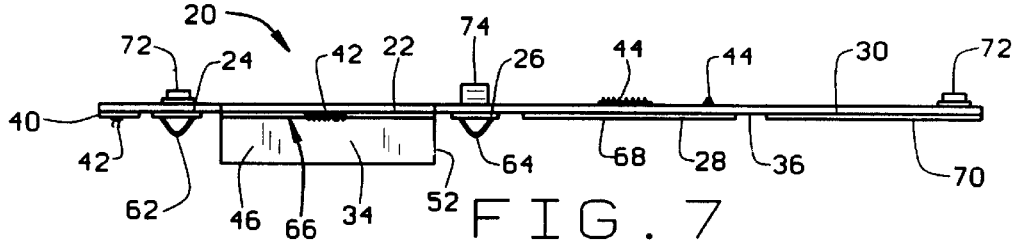
FIG. 7 is a top plan view of the fashion doll clothes holder.

A fashion doll clothes holder constructed according to the principles of this invention is indicated generally as 20 in the figures. The clothes holder 20 comprises a plurality of panels hingedly connected together to form a box-like enclosure, as shown best in FIGS. 3 and 4. The portions of the panels forming the interior of the enclosure are provided with fasteners to engage the fasteners provided on the doll clothing and accessories, so that the doll clothing and accessories can be releasably secured to the surfaces of the panels, and the thus-secured clothing and accessories held within the enclosure. One or more storage compartments can be provided to hold clothing and accessories that do not have suitable fasteners.

The clothes holder 20 comprises a back panel 22, left and right side panels 24 and 26 hingedly connected on the left and right sides, respectively, of the back panel, and a front panel 28 hingedly connected to the right side panel 26. An auxiliary panel 30 is hingedly connected to the front panel to provide additional storage. A top panel 32 is hingedly connected to the upper edge of the back panel 22. In lieu of a bottom panel, a storage compartment 34 is mounted adjacent the bottom edge of the back panel 22. In this preferred embodiment, the panels 22, 24, 26, 28 and 32 fold together and form the back, sides, front and top of the enclosure, respectively. The bottom of the enclosure is formed by the storage compartment 34. The panels are preferably hingedly connected with webs 36 of flexible material. In this preferred embodiment, the holder is made from a plurality of stiff cardboard panels clad with a flexible vinyl which forms the webs 36 between the panels.

There is a flap 38 on the top panel 32 and a flap 40 on the left side panel 24 are adapted to be folded over the exterior of the front panel 28 when the panels are folded to form the enclosure. The left end of the flap 38 and the upper end of the flap 40 are mitered so that the flaps do not overlap, and interfere with closing the enclosure. There are patches 42 of one half of a hook-and-loop type fastening material on the flaps 38 and 40 to engage mating patches 44 of the other half of a hook-and-loop type fastening material on the front panel, to releasably secure the panels in their folded configuration.

The storage compartment 34 preferably comprises a housing having a top 46, a bottom 48, and left and right sides 50 and 52 that project forwardly from the back panel 22, adjacent the bottom edge. The front of the housing is open, and three drawers 54, 56, and 58 are slidably mounted therein, separated by spacers 60. The drawers 54, 56, and 58 hold clothing and accessories that do not have fasteners, as described below. There are elongate pouches 62 and 64 on the left and right side panels 24 and 26, above the storage compartment 34. The pouches 62 and 64 are adapted to hold fashion dolls. In particular, elongate pouches 62 and 64 are of a similar size to standard fashion dolls to allow the insertion and storage of standard fashion dolls into the pouches.

At least some of the surfaces of the panels which form the interior surfaces of the enclosure have fasteners for engaging the fasteners that are typically provided on doll clothing such as pile material, hook-and-loop type fasteners and snaps. In this preferred embodiment, the fasteners are a lining of a pile material, for example, felt, which releasably engages the hook portions of hook-and-loop type fasteners commonly provided on fashion doll clothing and accessories. The lining can be provided on any of the panels that form the interior of the enclosure. In this preferred embodiment, there is a lining 66 on the interior surface of the back panel, a lining 68 on the interior surface of the front panel, and a lining 70 on the surface of the auxiliary panel.

Mounting loops 72 are provided on the outside surfaces of the panels, so that the holder can be temporarily hung when opened to display the doll clothes held on the interior surfaces of the panels. A carrying handle 74 is also mounted on the outside of the right panel 26, so that the enclosure can be conveniently carried when closed.

OPERATION

In operation, the holder 20 can be laid flat, stood up, leaned against a wall, or hung from the mounting loops 72. Fashion doll clothes and accessories can be easily attached to, and removed from the surfaces 66, 68 and 70 by simply engaging the hook portions of the hook-and-loop type fasteners on the clothing to one of the surfaces. This allows the doll clothes to be sorted and stored in a organized manner. Accessories and clothing that do not have hook-and-loop type fasteners can be stored in the drawers 54, 56 and 58. Dolls can be stored in the pouches 62 and 64. When play is over, the auxiliary panel 30 is folded against the front panel 28, and the front panel and auxiliary panels 28 and 30 are folded over the back panel 22 separated by the right side panel 26. The left side panel 24 is folded up, and the flap 40 is secured on the front panel 28 by engaging the mating fasteners 42 and 44. The top panel 32 is then folded up, and the flap 38 is secured on the front panel 28 by engaging the mating fasteners 42 and 44. The panels thus form a rectangular box-like enclosure with the clothes and accessories held inside the enclosure. The holder can be conveniently carried with the handle 74. The enclosure is easily opened by detaching the flaps 38 and 40 from the front panel 28, and unfolding the panels. The clothing and accessories can be easily removed and used or rearranged on the panels.

The holder is thus very simple and easy to use. It allows the user to sort and organize fashion doll clothes and accessories, and store the clothes and accessories in an organized manner. The clothes are easy to attach and remove from the interior surfaces of the enclosure, yet they are held sufficiently securely that they do not become detached during normal storage and transportation. The clothes and accessories are protected in the enclosure.

What is claimed:

1. A holder for dolls, doll clothes and accessories wherein the doll clothes have fasteners, said holder comprising:

a back panel having a left side and right side;

a left side panel hingedly connected to said back panel left side;

a right side panel hingedly connected to said back panel right side;

a front panel hingedly connected to a side of one of said left side panel and said right side panel;

an auxiliary panel hingedly connected to a side of said front panel;

wherein said back panel. said left side panel, said right side panel and said front panel substantially form a boxlike enclosure configured for storing three-dimensional articles wherein said auxiliary panel folds flat against said front panel, said back panel, said front panel and said auxiliary panel each having an inner surface; and a lining secured to and substantially covering said inner surface of at least one of said back panel, said front panel and said auxiliary panel, said lining adapted to releasably engage the fasteners on the doll clothes to secure the doll clothes for storage at substantially any location on said lining.

2. The holder of claim 1 further comprising an end flap extending from an outer side edge of one of said back panel, said front panel and said auxiliary panel, said end flap configured to secure to an outer surface of another of said back panel, said front panel and said auxiliary panel to hold said enclosure in the boxlike configuration.

3. The holder of claim 1 further comprising a storage compartment attached to said inner surface of said back panel, said storage compartment for holding clothes and accessories which do not have fasteners, wherein said storage compartment forms a bottom for said enclosure.

4. The holder of claim 1 wherein said lining comprises a pile material for releasably engaging hook portions of hook and loop type fasteners on the doll clothes.

5. The holder of claim 4 wherein said pile material comprises felt.

6. The holder of claim 1 wherein said lining comprises the loop portions of hook and loop type fasteners for releasably engaging hook portions of hook and loop type fasteners on the doll clothes.

7. The holder of claim 1 wherein said lining comprises the hook portions of hook and loop type fasteners for releasably engaging the loop portions of hook and loop type fasteners on the doll clothes.

8. The holder of claim 1 further comprising a top panel extending upwardly from an upper edge of one of said back panel, said front panel and said auxiliary panel, wherein said top panel forms a top of said enclosure when said panels are folded into the generally rectangular box configuration.

9. The holder of claim 8 wherein the top panel includes a flap adapted to fold over and engage one of the other panels to secure the panels in their folded configuration forming the enclosure.

10. A holder in accordance with claim 1 further comprising at least one pouch attached to at least one of said left side panel and said right side panel, said pouch configured to hold a doll.

11. A holder in accordance with claim 10 wherein said pouch is configured to hold a standard fashion doll.

12. A holder in accordance with claim 1 wherein said lining is secured to and substantially covers said back panel inner surface, said front panel inner surface, and said auxiliary panel inner surface.

* * * * *